US007936248B2

(12) United States Patent
Yoon et al.

(10) Patent No.: US 7,936,248 B2
(45) Date of Patent: May 3, 2011

(54) TI(N) THIN-FILM RESISTOR DEPOSITED ON ALN SUBSTRATE AND ATTENUATOR USING SAME

(75) Inventors: Soon-Gil Yoon, Daejeon (KR); Duy Cuong Nguyen, Daejeon (KR); Dong-Jin Kim, Busan (KR); Je-Cheon Ryu, Daejeon (KR)

(73) Assignee: The Industry & Academic Cooperation in Chungnam National University (IAC), Daejeon (KR)

( * ) Notice: Subject to any disclaimer, the term of this patent is extended or adjusted under 35 U.S.C. 154(b) by 526 days.

(21) Appl. No.: 12/149,449

(22) Filed: May 1, 2008

(65) Prior Publication Data

US 2009/0002123 A1 Jan. 1, 2009

(30) Foreign Application Priority Data

Jun. 28, 2007 (KR) ..... 10-2007-0064063

(51) Int. Cl.
*H01C 1/012* (2006.01)

(52) U.S. Cl. ..... 338/308; 438/592; 438/488

(58) Field of Classification Search ..... 338/308; 438/592, 488

See application file for complete search history.

(56) References Cited

U.S. PATENT DOCUMENTS

| | | | | |
|---|---|---|---|---|
| 6,149,999 | A * | 11/2000 | Suzuki et al. | 428/64.1 |
| 6,466,124 | B1 * | 10/2002 | Shibuya et al. | 338/308 |
| 6,573,169 | B2 * | 6/2003 | Noble et al. | 438/592 |
| 2004/0053492 | A1 * | 3/2004 | Sandhu et al. | 438/643 |
| 2006/0124983 | A1 * | 6/2006 | Kutsunai et al. | 257/306 |

OTHER PUBLICATIONS

Nguyen, Duy Cuong et al., "Ti(N) thin film resistors for 20 dB Π-type attenuator applications", Applied Physics Letters 90, (Received Jan. 27, 2007; accepted Apr. 5, 2007, published online May 1, 2007); pp. 1-3.

* cited by examiner

*Primary Examiner* — Kyung Lee
(74) *Attorney, Agent, or Firm* — Edwards Angell Palmer & Dodge LLP; Kongsik Kim

(57) ABSTRACT

The present invention relates to a thin-film resistor for an attenuator that is utilized in the fourth generation mobile communication, and more specifically, to a thin-film resistor having a Ti(N) thin film formed on an aluminum nitride (ALN) substrate. The thin-film resistor of the invention has superior electrical characteristics, such as sheet resistance, and superior characteristics in change of attenuation and voltage standing wave ratio (VSWR) with respect to changes of frequency and L/W, and thus the thin-film resistor can be utilized in a high frequency domain of up to 6 GHz.

6 Claims, 11 Drawing Sheets

TI(N) THIN-FILM RESISTOR DEPOSITED ON ALN SUBSTRATE AND ATTENUATOR USING SAME

CROSS-REFERENCE TO RELATED APPLICATIONS

This application claims the benefit of Korean Application No. 10-2007-0064063, filed on Jun. 28, 2007, in the Korean Intellectual Property Office, the disclosure of which is incorporated herein by reference.

BACKGROUND OF THE INVENTION

1. Field of the Invention

The present invention relates to a thin-film resistor for an attenuator that is utilized in the fourth generation mobile communication, and more specifically, to a thin-film resistor that can be used for an attenuator, in which the thin-film resistor fabricated by a Ti(N) thin-film deposition method has superior electrical characteristics, such as sheet resistance, and superior characteristics in changes of attenuation and voltage standing wave ratio (VSWR) with respect to changes of frequency and L/W.

2. Description of the Related Art

Until present, development and commercialization of parts used for mobile communication (CDMA, PCS, and WLL) and the next generation mobile communication (IMT-2000) are mainly focused on voice and data communication using narrow band frequencies of less than 3 GHz and output power of less than 5 W. Resistive elements used for the voice and data communication are generally thick-film resistors, in which a resistive material is mounted on an $Al_2O_3$ substrate in the form of a thick film. Since the resistive elements are fabricated in a small size and have excellent characteristics in narrow band frequencies less than 3 GHz, they are applied to the latest devices such as cellular phones, computers, and the like to implement satisfactory performance. Such resistive elements are fabricated and distributed in the form of a thick film using a thick film technique by KMC Tech. Co. of Korea.

However, it is quite naturally expected that transmission systems of a high power will be constructed for improved mobile communication services that will come within a few years, and thus passive elements for the next generation communication, i.e., high-power passive elements in preparation for the fourth generation mobile communication, are absolutely necessary. For passive elements of the next generation mobile communication, it is desirable to replace thick-film elements with thin-film elements having a higher resistance tolerance, a more precise temperature coefficient of resistance, and superior current-noise and high-frequency characteristics as compared with the thick film element.

Advantages obtained by replacing thick-film resistors with thin-film resistors are as follows: first, decrease of parasite components due to decrease in thickness; second, possibility of implementing Near Zero TCR; third, applicability to monolithic microwave integrated circuit (MMIC) by securing fundamental technologies; and fourth, possibility of constructing mass-production systems. Therefore, in the fourth generation mobile communication using the thin-film elements, it is possible to provide a service capable of processing a large volume of data in a speedy way regardless of time and space using a frequency band of 5.7 GHz. Owing to such advantages, researches on the thin-film resistors are in progress all over the world, and companies such as RD Florida and KDI/Triangle demonstrate data on thin-film resistors using a BeO substrate at a frequency of about 4 GHz.

However, since the specification of the thin-film resistors shows a VSWR as high as 1.5, studies for reducing the VSWR are continued.

SUMMARY OF THE INVENTION

Therefore, the present invention has been made in view of the above problems, and it is an object of the present invention to provide a thin-film resistor that can be utilized in a high frequency domain of up to 6 GHz. The thin-film resistor fabricated by a thin-film deposition method has superior electrical characteristics, such as sheet resistance, and superior characteristics in changes of attenuation and voltage standing wave ratio (VSWR) with respect to changes of frequency and L/W.

In order to accomplish the object, there is provided a thin-film resistor comprising a Ti(N) thin film formed on an aluminum nitride (ALN) substrate.

The term 'thin-film resistor' as defined herein refers to a thin film deposited with a resistant material through a thin-film depositing process.

A substrate of thin-film resistors should have a low dielectric loss and a high thermal conductivity so as to be used at a high frequency. That is, it should have a dielectric loss of 0.0001 at a frequency of 1 MHz. Substrates widely used for the thin-film resistors include BeO, ALN, and $Al_2O_3$ substrates. However, since BeO is known to emit a cancer-causing material that is harmful to the human body in the process of fabricating, it is problematic in being used as a substrate of thin-film resistors. On the other hand, since $Al_2O_3$ has a low thermal conductivity (about 35 W/mK), it is inappropriate to be used as a substrate of thin-film resistors. However, since ALN has a very high thermal conductivity of about 190 W/mK and a very low dielectric loss of 0.0001, it is adopted as a substrate of thin-film resistors in the present invention.

Ti(N) is titanium (Ti) doped with nitrogen, which has superior electrical characteristics, in addition to superior electrical and thermal characteristics, due to a high melting point and corrosion resistance.

The thin-film resistor according to the present invention has a structure in which an interface layer is formed of an amorphous film on an ALN substrate, and a Ti(N) thin film of a crystallized state is formed on the interface layer. The thickness of the interface layer is about 5 nm, which is almost uniform regardless of the thickness of the thin film. The Ti(N) thin film is preferably formed with a thickness of 20 to 199 nm, further preferably 50 to 80 nm. If the Ti(N) thin film is too thin, the proportion occupied by the interface layer to the entire thin film increases, and thus the Ti(N) thin film is largely affected by the electrical characteristic of the interface layer. Contrarily, if the Ti(N) thin film is too thick, the advantages of the thin-film resistor over the thick film resistor may not be sufficiently utilized.

The characteristics of the sheet resistance and the temperature coefficient of resistance of the thin-film resistor according to the present invention may be applied to 20 dB.

The thin-film resistor according to the invention may be fabricated by depositing a Ti(N) thin film on a polished surface of an ALN substrate using Ti as a target and argon/nitrogen mixed gas as sputtering gas. The volume ratio of the nitrogen gas in the argon/nitrogen mixture gas is preferably 1 to 5%. The volume ratio of nitrogen to injection gas ($N_2/(Ar+N_2)$) affects resistance and a temperature coefficient of resistance of the thin-film resistor. The temperature coefficient of resistance (TCR) is a coefficient representing dependency of resistance on temperature, which represents the degree of change in resistance that is affected by the heat generated when an element is used in an electronic device. A positive value represents increase of resistance as the temperature of a thin film increases. The temperature coefficient of resistance characteristic is getting better as the temperature coefficient of resistance is close to zero. Many industrial companies use thin-film resistors having a temperature coefficient of resistance characteristic less than ±100 ppm/° C. If the volume ratio of nitrogen is lower than 1%, resistance decreases, and the temperature coefficient of resistance (TCR) characteristic shows a large positive value, whereas if the volume ratio of nitrogen is higher than 5%, resistance increases, and the temperature coefficient of resistance (TCR) characteristic shows a large negative coefficient value, and thus it is difficult to apply the element.

The thin-film resistor according to the present invention may be patterned to be used as an element of an attenuator. Only an attenuator that is patterned in a Π-type is described in Examples of the present invention, but it is not limited thereto. Other than the Π-type, an attenuator patterned in a T-type, bridged T-type, U-type, L-type, and O-type may be used.

FIG. 1 is a mimetic view showing an equivalent circuit of a Π-type attenuator according to an embodiment of the present invention. Depending on the structure, the attenuator may be divided into a fixed attenuator having a fixed attenuation value and a variable attenuator that can change the amount of attenuation. FIG. 1 is a mimetic view showing an equivalent circuit of a Π-type attenuator among the fixed attenuators, in which the attenuator uses two different resistances $R_1$ 100 and $R_2$ 101.

A Π-type attenuator of a 20 dB/25 W class is fabricated using a Ti(N) thin-film resistor of the present invention, and characteristics of the Π-type attenuator are compared with those of an attenuator of a conventional thick film resistor. As a result, device characteristics of the Ti(N) thin-film resistor such as attenuation and VSWR are further more superior to attenuation device characteristics of the conventional thick film resistor. Such characteristics may not be obtained from a thick film resistor, and it may be confirmed that the present invention provides a material and a process for fabricating an element suitable for an attenuator that will be utilized for the fourth generation mobile communication in the future.

According to the thin-film resistor of the invention fabricated by depositing a Ti(N) thin film on an ALN substrate, the thin-film resistor has superior electrical characteristics, such as sheet resistance, and superior characteristics of changes in attenuation and voltage standing wave ratio (VSWR) with respect to change of frequency and L/W, and thus the thin-film resistor can be utilized in a high frequency domain of up to 6 GHz.

DETAILED DESCRIPTION OF THE PREFERRED EMBODIMENTS

The preferred embodiments of the invention will be hereafter described in detail, with reference to the accompanying drawings.

EXAMPLES

Example 1

Fabrication of Ti(N) Thin-Film Resistor

An ALN substrate with a polished surface was washed in order of using acetone, methanol, and de-ionized (DI) water, and foreign particles on the surface of the ALN substrate were removed using $N_2$ gas. Then, a Ti(N) thin film was deposited on the ALN substrate using a dc magnetron sputtering method that uses DC current, in a chamber that can form high vacuum using rotary and turbo molecular pumps. At this point, Ti (99.999%) was used as a target, and a mixture of argon (Ar) and nitrogen ($N_2$) gases was used as sputtering gas. The volume ratio of the nitrogen to the mixture gas ($N_2/(Ar+N_2)$) was about 2%. In addition, voltage applied to the Ti target was 150 W, and the thin film is deposited on the ALN substrate at room temperature while maintaining a degree of vacuum to 2 mTorr during the process.

Thin-film resistors of various thicknesses described in the following Example were fabricated by adjusting thicknesses of the thin-film resistors with deposition time under the conditions described above.

Example 2

Figure 1:
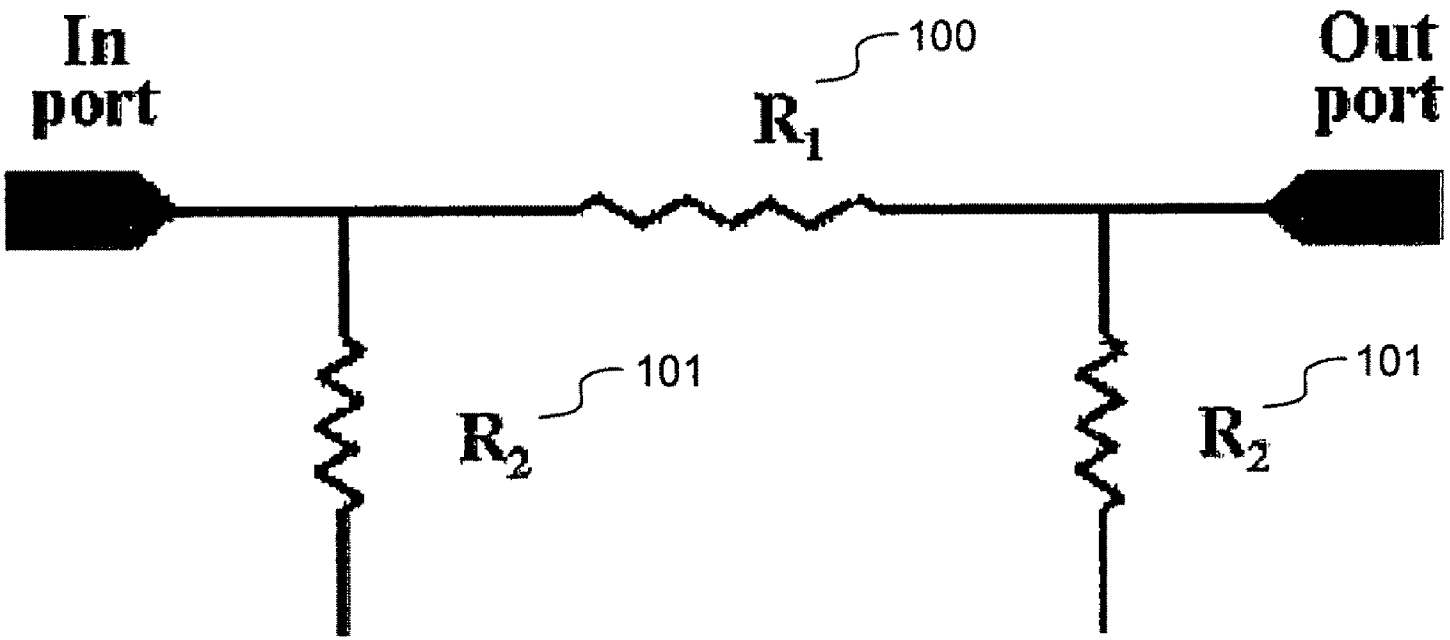
FIG. 1 is a mimetic view showing an equivalent circuit of a Π-type attenuator according to an embodiment of the present invention.
Figure 2:
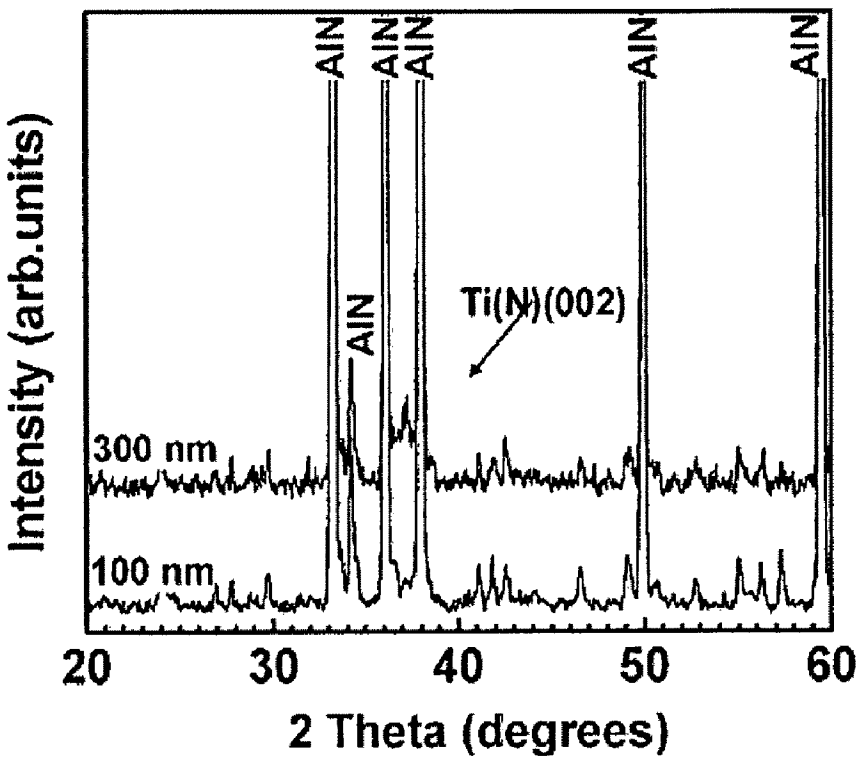
FIG. 2 shows XRD patterns by the thickness of Ti(N) thin films deposited on an ALN substrate at room temperature.

Analysis on Physical and Chemical Characteristics of Ti(N) Thin-Film Resistors On the Ti(N) thin-film resistors fabricated in the method described in the Example 1, crystal structures and directionalities of the Ti(N) thin films were measured by X-Ray diffraction (XRD, REGAKU D/MAX-RC) using Cu kα radiation together with a nickel filter. As shown in FIG. 2, only sharp peaks of the ALN substrate were observed from Ti(N) thin films having thicknesses of 100 nm and 300 nm, and the Ti(N) (002) peak was observed weakly at about 2θ=37.5°, so that it was difficult to observe the degree of crystallinity, such as a crystal structure, directionality, and the like of a thin film, using an XRD apparatus.

Figure 3A:
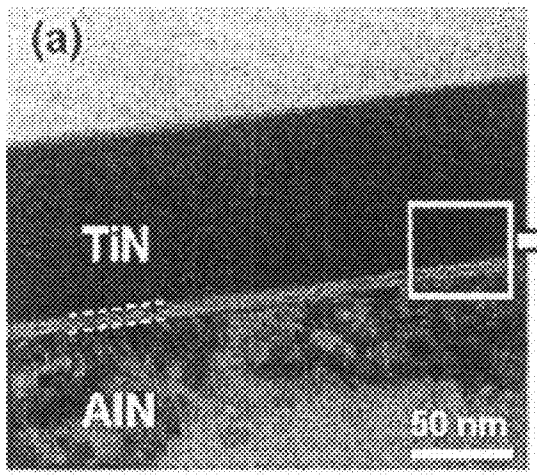
FIG. 3A to 3D are views showing TEM pictures of Ti(N) thin films respectively formed with thicknesses of 40 nm and 80 nm on an ALN substrate.
Figure 3B:
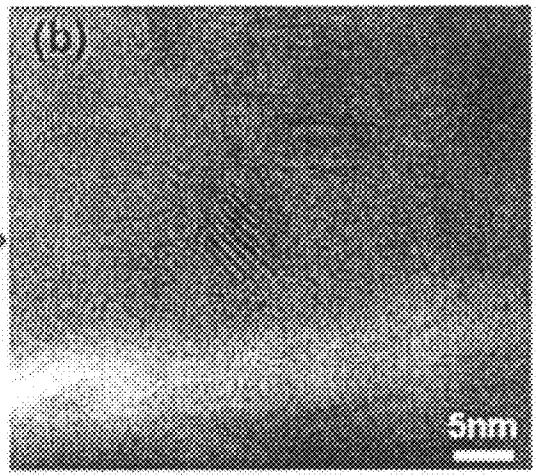
Figure 3C:
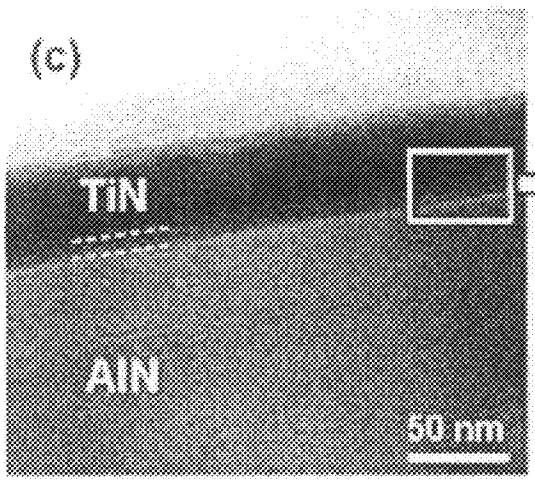
Figure 3D:
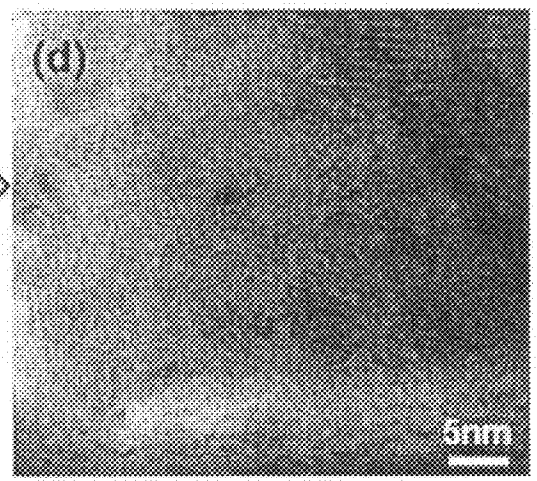

Accordingly, TEM analysis (JEOL JEM2000EX) was performed on two thin films having thicknesses of 40 nm and 80 nm in order to confirm crystallization of thin films as shown in FIG. 3A to 3D. FIGS. 3A and 3C are TEM pictures of the cross-sections of thin films respectively having thicknesses of 80 nm and 40 nm, and it is understood that Ti(N) thin films are formed, and interfaces exist between the Ti(N) films and the AlN substrate. FIGS. 3B and 3D are pictures showing the interfaces of FIGS. 3A and 3C enlarged by 10 times. The interfaces of the two thin films were formed of an amorphous film having a thickness of about 5 nm, and both of the Ti(N) thin films respectively having thicknesses of 80 nm and 40 nm showed a crystallized state. Since the proportion of the 5 nm interface to the entire thickness of the Ti(N) thin film having a thickness of 40 nm is higher than that of the Ti(N) thin film having a thickness of 80 nm, it is determined that the thinner the interface between the Ti(N) thin film and the substrate is, the higher the electrical characteristics are affected.

Example 3

Evaluation of Electrical Characteristics of Thin-Film Resistors

Sheet resistances of the thin-film resistors fabricated in Example 1 were measured using a 4 point probe system (Electrometer (CMT-SR 1000)).

Figure 4:
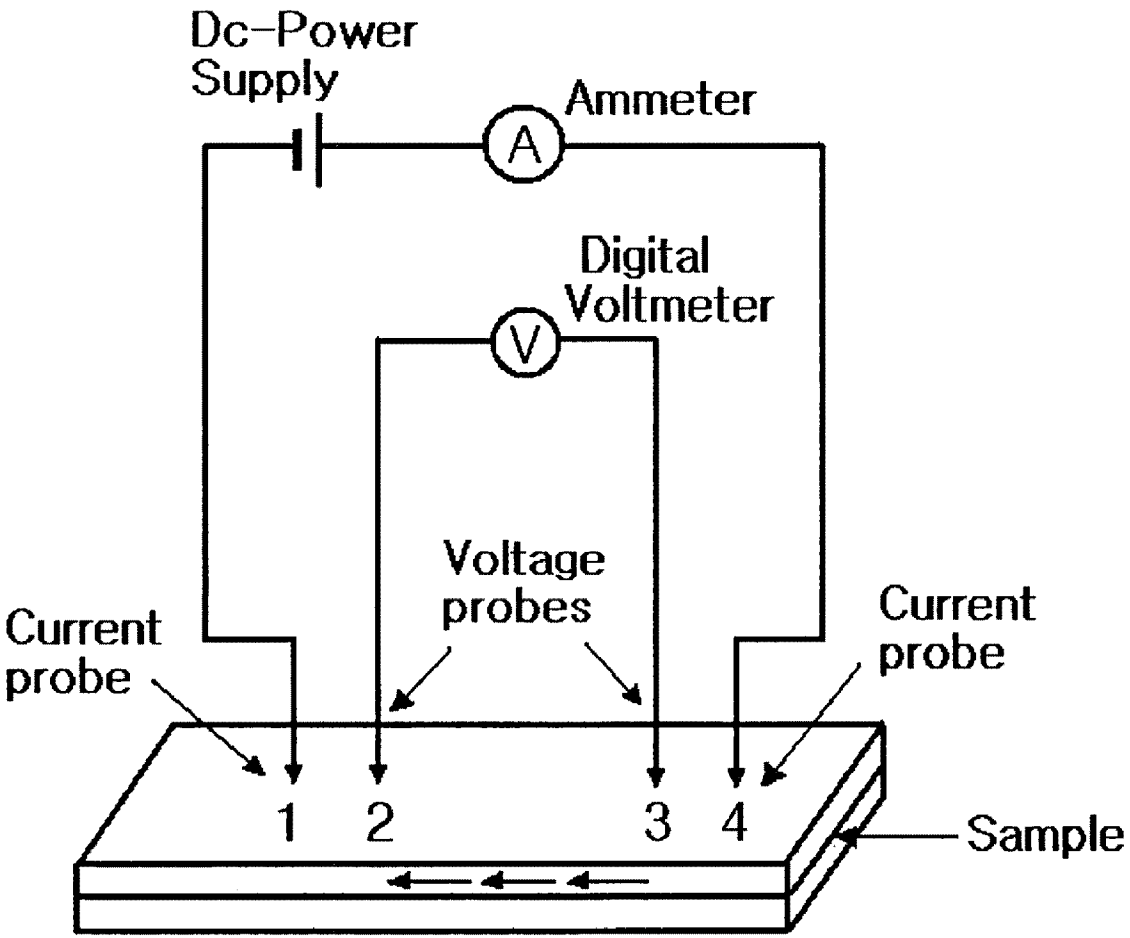
FIG. 4 is a schematic view showing the measurement of sheet resistances.

FIG. 4 is a schematic view showing the measurement of sheet resistances.

Figure 5:
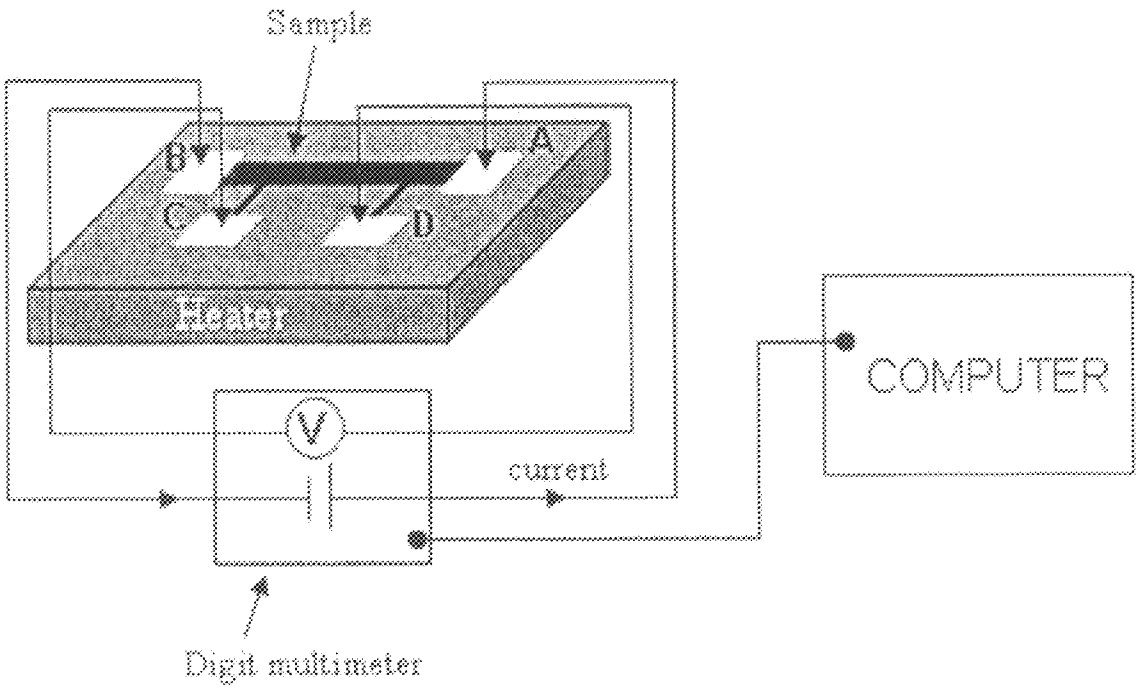
FIG. 5 shows a schematic view of measuring temperature coefficients of resistance.

As shown in FIG. 5, to measure change of temperature coefficients, Ti(N) was deposited on an ALN substrate using a four terminal pattern through a photo process, and an electrode pattern was formed thereon. Then, a chrome (Cr) insertion layer was deposited on the electrode pattern layer to enhance adhesive power, and silver (Ag) and gold (Au) were deposited as electrode materials. (Structure of electrode material: Ag/Cr, Au/Cr).

As shown in FIG. 5, portions through which current flows in and out are prepared at both ends, and temperature coefficients of resistance of the thin-film resistors were measured by measuring a difference of voltage at the center while raising temperature from 25° C. to 125° C. at the speed of 5° C./minute on the hot chuck.

Figure 6:
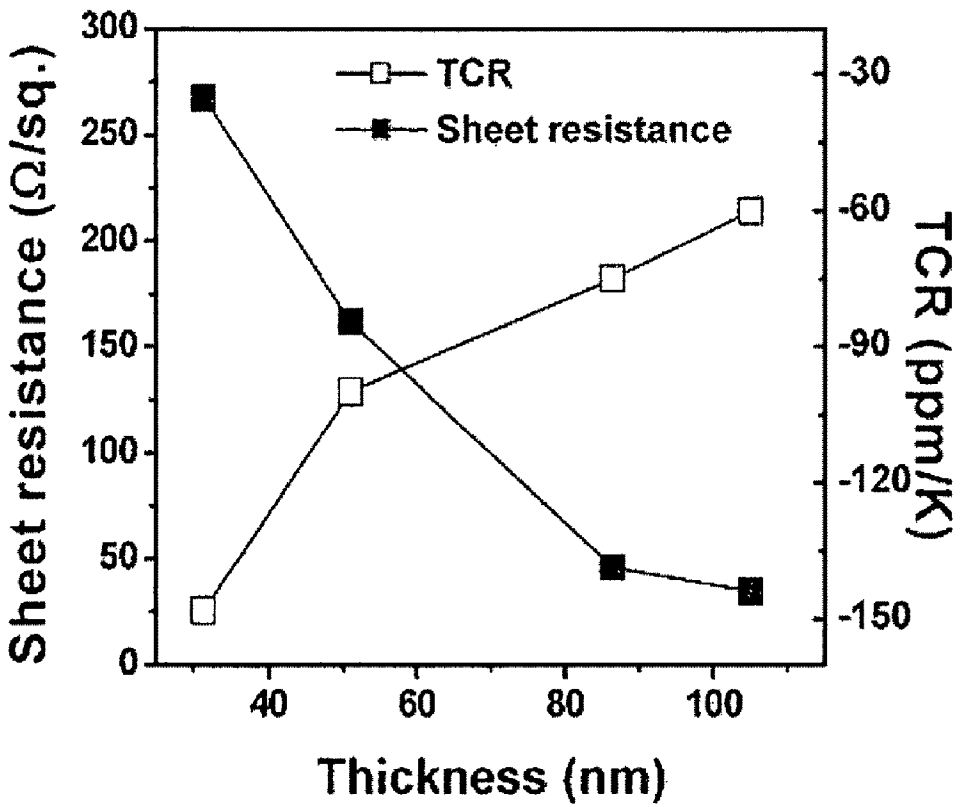
FIG. 6 is a graph showing changes of sheet resistance and temperature coefficient of resistance (TCR) by the thickness of the Ti(N) thin films deposited on an ALN substrate.

FIG. 6 is a view showing change of sheet resistances and temperature coefficients of resistance (TCR) with respect to thicknesses of the Ti(N) thin films measured in the method described above. As shown in FIG. 6, as the thicknesses of thin films were increased, sheet resistances were decreased, and inversely, temperature coefficients were increased from a large negative number to a small negative number. It was confirmed that all of the thin films shown in FIG. 6 had an electrical characteristic applicable to 20 dB.

Example 4

Design and Fabrication of a Π-type attenuator based on a simulation

Figure 7:
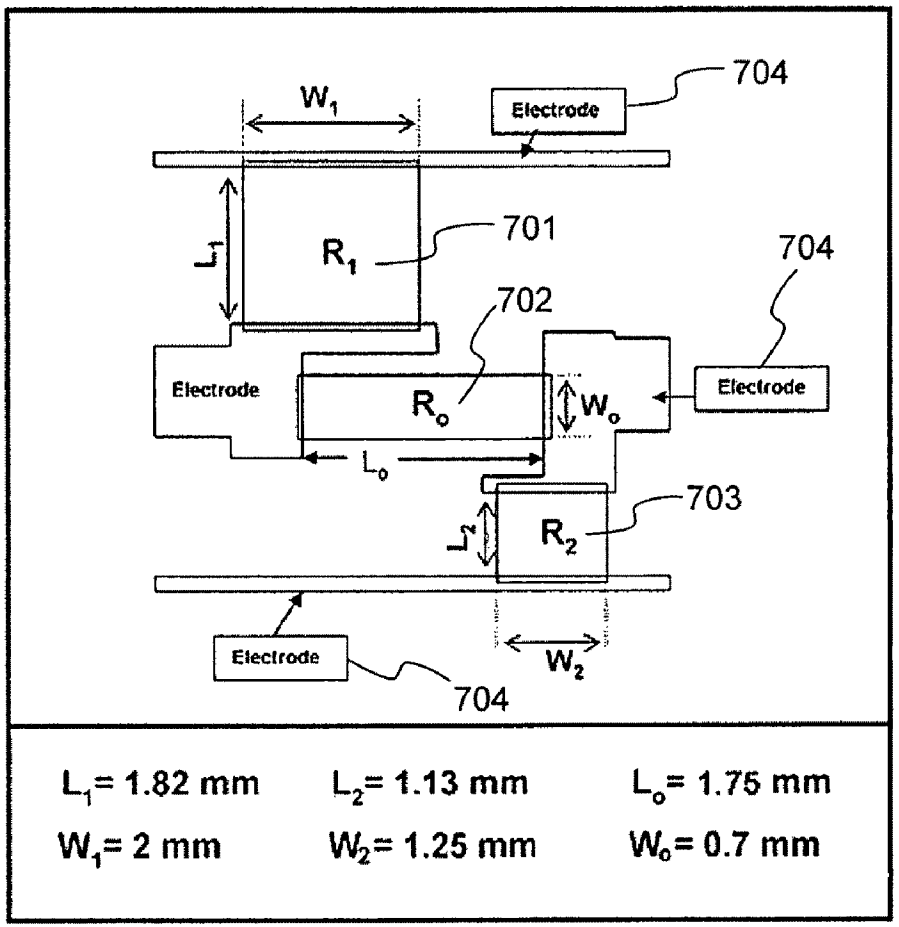
FIG. 7 is a mimetic view showing a pattern of resistors and electrodes in a device simulated for a Π-type attenuator of a 20 dB/25 W class.

The sizes of three resistors $R_1$ 701, $R_0$ 702, and $R_2$ 703 and arrangement of electrodes 704 constructing the Π-type attenuator shown in FIG. 7 were determined through an appropriate simulation. A 2.5D field simulator was used as a simulation tool, for which Designer of Ansoft, Momentum of Agilent, emSuite of Sonnet, EMSight of AWR, and the like were used. Resistance of the pattern was calculated in accordance with an impedance of 50 ohm, which is a reference of a high frequency element, and the length L and width W of each resistor were determined after evaluating a pattern that minimizes high frequency characteristics, including a resistance, a capacitor component (C), an inductance component (I), and the like, through a simulation. Table 1 shows a range of resistances needed at each dB for the Π-type attenuator obtained through a simulation.

An attenuator based on the design described above was fabricated using the Ti(N) thin resistors fabricated in Example 1, by adjusting the thickness of the thin film at a corresponding L/W ratio to satisfy the required resistance while changing the design (L/N) of $R_0$ of the Π-type attenuator pattern shown in FIG. 7 to L/W=2.5, 3, and 3.5. That is, in an attenuator of 20 dB/25 W, thickness of the $R_1$ resistive film was fixed to 80 nm, and thickness of the used resistive thin film was changed from 70 to 80 nm in order to satisfy the required resistance.

TABLE 1

| Attenuation | Impedance | $R_0$ | $R_{1,2}$ |
|---|---|---|---|
| 1 | 50 | 869.55 | 5.77 |
| 2 | 50 | 436.21 | 11.61 |
| 3 | 50 | 292.40 | 17.61 |
| 4 | 50 | 220.97 | 23.85 |
| 5 | 50 | 178.49 | 30.40 |
| 6 | 50 | 150.48 | 37.35 |
| 7 | 50 | 130.73 | 44.80 |
| 8 | 50 | 116.14 | 52.84 |
| 9 | 50 | 104.99 | 61.59 |
| 10 | 50 | 96.25 | 71.15 |
| 11 | 50 | 98.24 | 81.66 |
| 12 | 50 | 83.54 | 93.25 |
| 13 | 50 | 78.84 | 106.07 |
| 14 | 50 | 74.93 | 120.31 |
| 15 | 50 | 71.63 | 136.14 |
| 16 | 50 | 68.83 | 153.78 |
| 17 | 50 | 66.45 | 173.46 |
| 18 | 50 | 64.40 | 195.43 |
| 19 | 50 | 62.64 | 220.01 |
| 20 | 50 | 61.11 | 247.50 |
| 21 | 50 | 59.78 | 278.28 |
| 22 | 50 | 58.63 | 312.75 |
| 23 | 50 | 57.62 | 351.36 |
| 24 | 50 | 56.73 | 394.65 |
| 25 | 50 | 55.96 | 443.16 |
| 26 | 50 | 55.28 | 497.56 |
| 27 | 50 | 54.68 | 558.56 |
| 28 | 50 | 54.15 | 626.98 |
| 29 | 50 | 53.68 | 730.71 |
| 30 | 50 | 53.27 | 789.78 |

When resistance of each resistor in the Ti(N) thin-film resistor is beyond the designed resistance range, the resistance is adjusted to be within the resistance range through a scan method in which a resistive film is horizontally cut using a laser as a post trimming process to reduce minute errors.

Example 5

Device Characteristics of a Π-Type Attenuator Device

Device characteristics of the Π-type attenuator device fabricated in Example 4 were examined. For the comparison, attenuations were measured with respective to change of frequency for the Π-type attenuator using a thin-film resistor of the present invention and an attenuator using a thick film resistor, and the result of the measurement was shown in FIG. 8. A film having a thickness of 3 to 8 μm (KMC technology) formed of an RuO2 paste on an ALN substrate was used as a thick film resistor, and an attenuator was fabricated using the same pattern as was used for the r-type attenuator of a thin-film resistor for the comparison.

Figure 8:
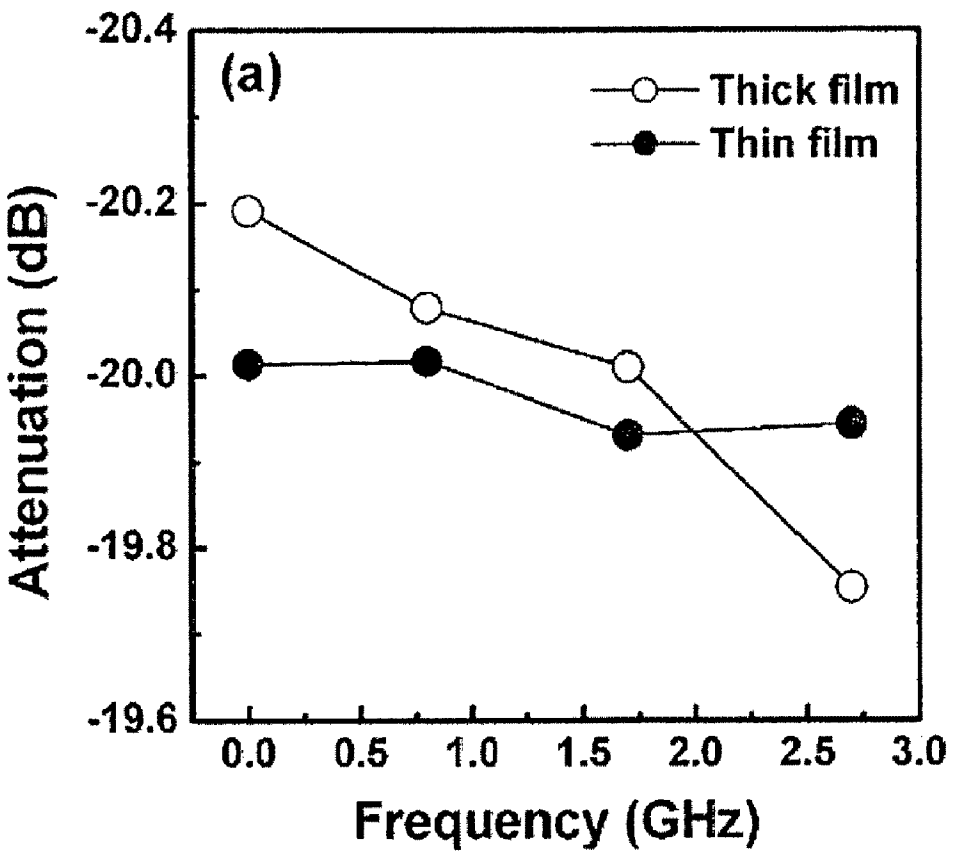
FIG. 8 is a graph showing change of attenuation with respect to change in frequency of Π-type attenuators using a commercialized thick film resistor and a thin-film resistor according to the present invention.

As shown in FIG. 8, as the frequency increases up to 3 GHz, attenuation of the attenuator device comprising a thick resistor shows a characteristic deviating from 20 dB. However, in the case of the device comprising a thin-film resistor, attenuation does not greatly deviate from 20 dB although the frequency increases up to 3 GHz, and thus it is understood that the device comprising a thin-film resistor shows a superior device characteristic.

Figure 9:
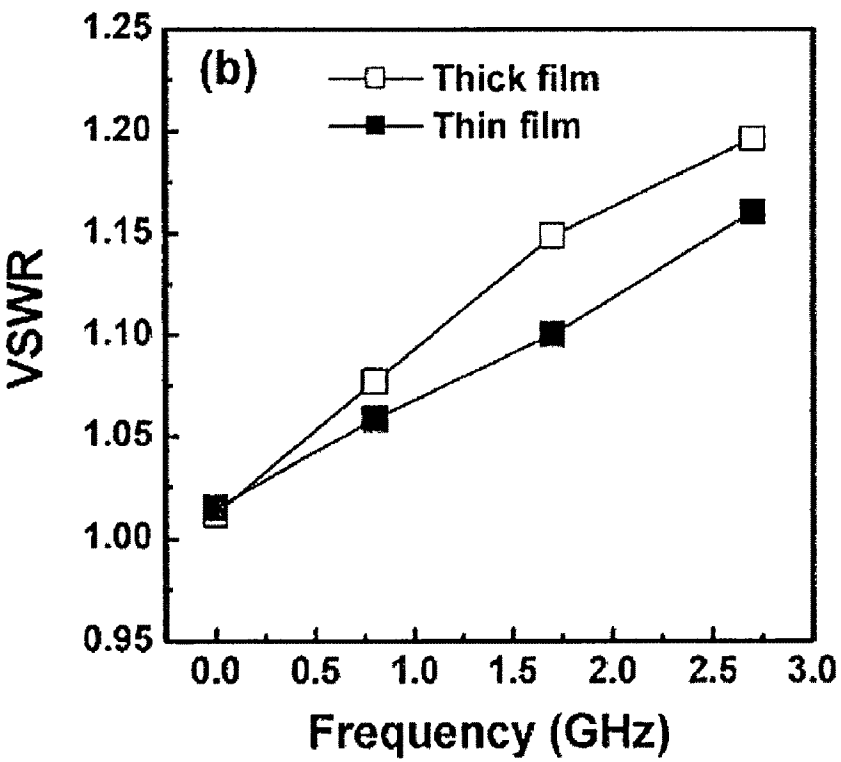
FIG. 9 is a graph showing change of voltage standing wave ratio (VSWR) with respect to change in frequency of Π-type attenuators using a commercialized thick film resistor and a thin-film resistor according to the present invention.

FIG. 9 shows change of voltage standing wave ratios (VSWRs) with respect to change in frequency of attenuation devices respectively comprising a thick film resistor and a thin-film resistor. It is the most ideal to show values close to 1.00 regardless of the change of frequency.

Compared with the thick film, the thin film has lower increasing values. From this result, it can be seen that the device comprising a thin film shows a further superior characteristic in VSWR values.

Figure 10:
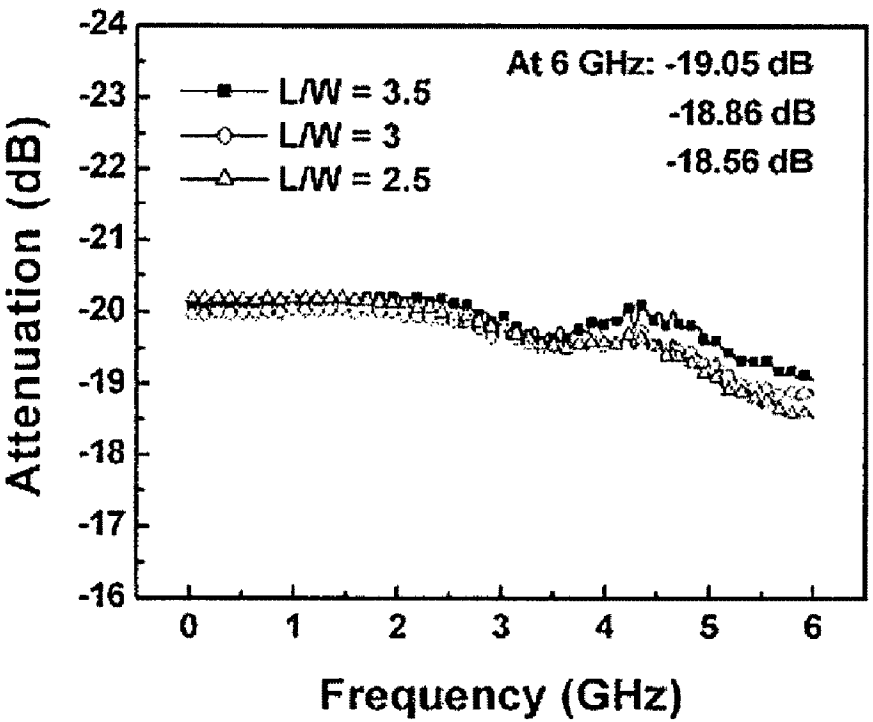
FIG. 10 is a graph showing change of attenuations with respect to change in frequency of Π-type attenuators using Ti(N) thin-film resistors according to the present invention.

FIG. 10 shows attenuations that are changed as frequency changes up to 6.0 GHz for various L/Ws (a ratio of length to width of the resistance pattern of $R_0$) in a device using a thin-film resistor. As shown in FIG. 10, although change of attenuation with respect to change of L/W is not so big up to 3 GHz, attenuation is changed depending on the L/W at 6 GHz. Change of attenuation is the smallest when L/W is 3.5, and thus it can be confirmed to have a superior.

However, VSWRs were measured with respect to the change of frequency for devices having various L/W values (FIG. 11), and the device having an L/W value of 2.5 showed the smallest VSWR of 1.19 at 6 GHz.

Figure 11:
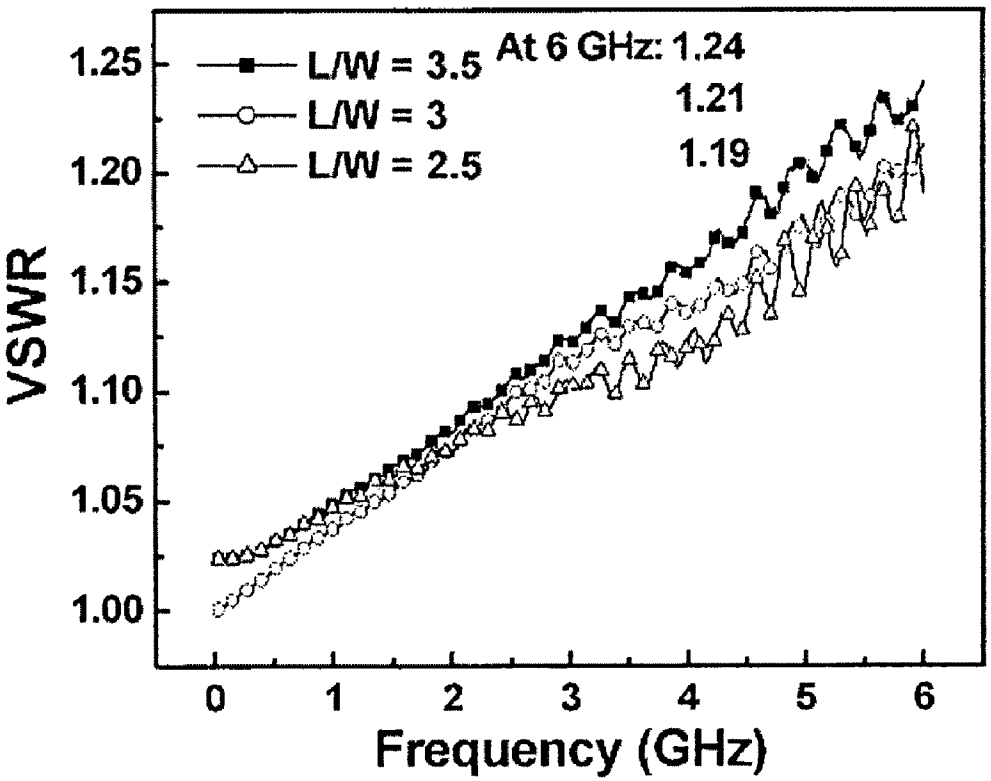
FIG. 11 is a graph showing change of VSWRs with respect to change in frequency of Π-type attenuators using Ti(N) thin-film resistors according to the present invention.

As shown in FIGS. 10 and 11, design (L/W) of $R_0$ among the Π-type attenuator pattern was changed (L/W of previous design is 4) to improve high frequency characteristics (attenuation and VSWR) of the fabricated thin-film resistor, and the characteristics were observed. As a result, within the design range (L/W=2.5, 3, and 3.5), a sample of L/W=3.5 showed a little better attenuation characteristic, and a sample of L/W=2.5 showed a little superior voltage standing wave ratio (VSWR). Although both of the attenuation and VSWR are fundamental and important characteristics, the attenuation may be considered as a concept of loss and can be compensated when the attenuation is lower than a target value (20 dB), and thus the VSWR characteristic is more important.

According to the present invention, it is possible to be provided with a service capable of processing a large volume of data in a speedy way regardless of time and space using a frequency band of 5.7 GHz that can be utilized in the fourth generation mobile communication. Furthermore, a thin-film deposition technique applicable to an attenuator is established, and a thin-film technique may be applied by making a progress from a conventional thick film technique.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

What is claimed is:

1. A thin-film resistor comprising:

an ALN substrate;

an amorphous interface layer of Ti(N) formed on the ALN substrate; and a thin film of crystalline Ti(N) formed on the interface layer.

2. The thin-film resistor according to claim 1, wherein thickness of the Ti(N) thin film ranges from 20 nm to 100 nm.

3. A method of fabricating a thin-film resistor according to claim 1, further comprising depositing the Ti(N) thin film on a polished surface of an ALN substrate using Ti as a target and argon/nitrogen mixed gas as sputtering gas.

4. The method according to claim 3, wherein a volume ratio of nitrogen gas in the argon/nitrogen mixture gas is 1 to 5%.

5. An attenuator using the thin-film resistor according to claim 1.

6. The attenuator according to claim 5, wherein a capacity of the attenuator is a 25 W class at 20 to 30 dB.

* * * * *